US005184907A

United States Patent [19]

Hamada et al.

[11] Patent Number: 5,184,907

[45] Date of Patent: Feb. 9, 1993

[54] PORTABLE PRINTER FOR PRINTING ON A FLAT SHEET

[75] Inventors: Akira Hamada, Osaka; Yasuji Obuchi; Hirokatsu Akiyama, both of Nara, all of Japan

[73] Assignee: Sharp Kabushiki Kaisha, Osaka, Japan

[21] Appl. No.: 694,010

[22] Filed: Apr. 30, 1991

Related U.S. Application Data

[63] Continuation of Ser. No. 315,251, Feb. 21, 1989, abandoned, which is a continuation of Ser. No. 115,267, Oct. 30, 1987, abandoned.

[30] Foreign Application Priority Data

Nov. 6, 1986 [JP] Japan ..... 61-265145

[51] Int. Cl.[5] ..... B41J 13/08

[52] U.S. Cl. ..... 400/635; 400/29

[58] Field of Search ..... 400/635, 23, 29, 88, 400/605, 611, 634, 656, 691; 101/232; 271/275, 276, 277; 346/134, 136; 355/308, 309

[56] References Cited

U.S. PATENT DOCUMENTS

| | | | |
|---|---|---|---|
| 2,912,091 | 11/1989 | Gemmel | 400/615.2 |
| 3,074,532 | 1/1963 | Balaz | 101/232 |
| 3,366,042 | 1/1968 | Birch | 101/27 |
| 4,620,807 | 11/1986 | Polit | 101/232 |
| 4,650,350 | 3/1987 | Dorner | 400/120 |
| 4,664,544 | 5/1987 | Miyako et al. | 400/605 |
| 4,821,049 | 4/1989 | Eckl | 346/134 |
| 4,919,409 | 4/1990 | Stemmle | 271/275 |

FOREIGN PATENT DOCUMENTS

| | | | |
|---|---|---|---|
| 38176 | 10/1981 | European Pat. Off. | 400/162 |
| 123354 | 10/1984 | European Pat. Off. | 400/635 |
| 3211451 | 10/1982 | Fed. Rep. of Germany | 400/29 |
| 111281 | 8/1980 | Japan | 400/55 |
| 10472 | 2/1981 | Japan | 400/88 |
| 61279 | 4/1985 | Japan | 400/708 |
| 137675 | 7/1985 | Japan | 400/605 |
| 147340 | 8/1985 | Japan | 400/635 |
| 54967 | 3/1986 | Japan | 400/662 |
| 233571 | 10/1986 | Japan | 400/59 |
| 2082509 | 3/1982 | United Kingdom | 400/88 |

*Primary Examiner*—David A. Wiecking
*Attorney, Agent, or Firm*—Morrison & Foerster

[57] ABSTRACT

A portable word processor transports a printing sheet along a straight path without flexing or bending it such that its output can be printed by a printer head even on an inflexible sheet.

2 Claims, 1 Drawing Sheet

PORTABLE PRINTER FOR PRINTING ON A FLAT SHEET

CROSS REFERENCE TO RELATED APPLICATIONS

This application is a continuation of our earlier filed U.S. application Ser. No. 07/315,251, filed Feb. 21, 1989, now abandoned which application is a continuation of U.S. application Ser. No. 07/115,267, filed Oct. 30, 1987, now abandoned both of which applications are being incorporated herein by reference and to which applications we claim priority under 35 USC §120. Further, this application is based on Japanese application 61-265145 to which we claim priority under 35 USC §119.

BACKGROUND OF THE INVENTION

This invention relates to a portable word processor and more particularly to a portable word processor with a printer capable of printing its output on a non-flexible sheet.

As shown in FIG. 5, for example, the conventional printer for a portable word processor such as a portable Japanese language processor typically contains within its housing 1 a paper feeding roller 2 having a frictional surface such that a sheet of printing paper 4 inserted through an inlet 3 provided at the upper backward part of the housing 1 is flexed when it is transported as the roller 2 is rotated and is thereafter taken out through an outlet 5 provided in front of the paper inlet 3. With a word processor having a printer of this conventional design, sheets of printing paper cannot be advanced as a matter of principle unless they are flexed and this means that printing cannot be effected with a word processor of this type on a thick card or a board.

SUMMARY OF THE INVENTION

It is therefore an object of the present invention to eliminate the aforementioned disadvantage by providing a portable word processor capable of printing its output also on a non-flexible card, a board or the like (hereinafter simply referred to as a sheet).

The above and other objects of the present invention are achieved by providing a portable word processor with a printer comprising a sheet transporting means for advancing a printing sheet along a straight line without flexing it and a printing head for printing on the sheet transported by this sheet transporting means.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
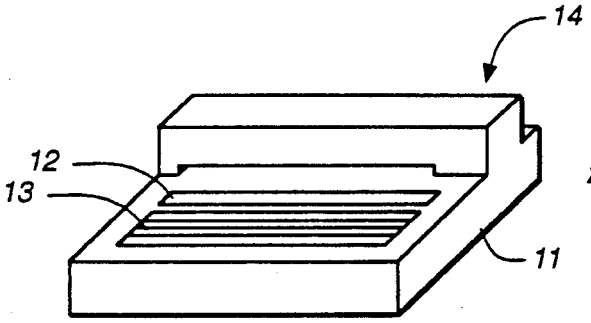
FIG. 1 is a schematic external view of a portable word processor embodying the present invention.

With reference to FIG. 1, a portable word processor embodying the present invention has an approximately rectangular box-shaped housing 11 which contains the main body of the word processor (not shown) and includes a display section 12 using, for example, a liquid crystal display device, a keyboard 13 and a printer 14 on its upper surface.

Figure 2:
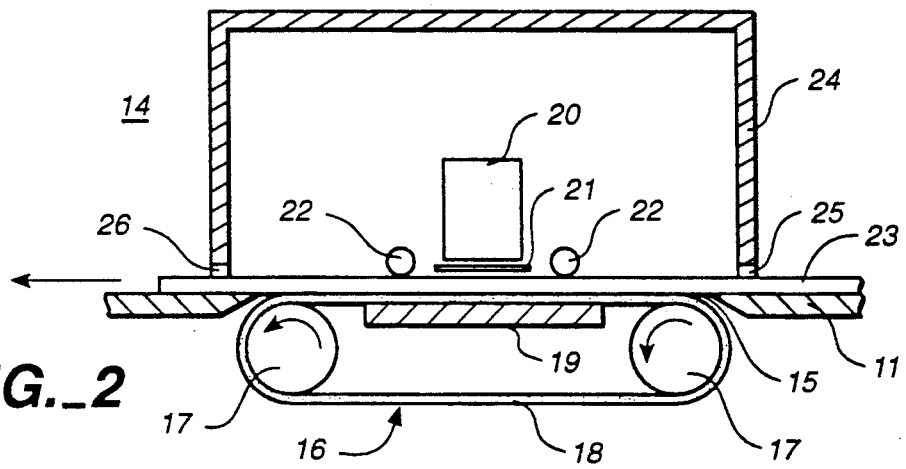
FIG. 2 is a schematic sectional view of the word processor of FIG. 1.

With reference next to FIG. 2, the upper surface of the housing 11 is provided with an elongated opening 15 immediately above a sheet transporting mechanism 16 including a pair of rollers 17 and an endless belt 18 stretched over these rollers 17 to form a conveyor. The external surface of the belt 18 is frictional and its width is approximately the same as the length of the opening 15. The length of the belt 18 between the rollers 17 is approximately the same as the width of the opening 15 such that the upper surface of the belt 18, which is supported from below by a supporting plate 19, nearly completely covers the opening 15 and is flush with the edges thereof.

Above the supporting plate 19 and the upper part of the belt 18 thereon, there are a printer head 20 and an ink ribbon 21. The sheet transporting mechanism 16, the printer head 20 and the ink ribbon 21 may together be referred to as the printer 14. Although a printer head of the so-called impact type using an ink ribbon is disclosed, use may equally well be made of a printer of a non-impact type such as an ink jet printer, a thermal printer and a transfer printer.

With reference still to FIG. 2, numerals 22 indicate members for pressing a printing sheet 23 downward tightly against the top surface of the belt 18 such that the sheet 23 will not be wrinkled during the printing operation. Numeral 24 indicates a cover for the printer 14 and an inlet 25 and an outlet 26 for the sheet 23 are provided respectively at the back and front bottom edges.

Figure 3:
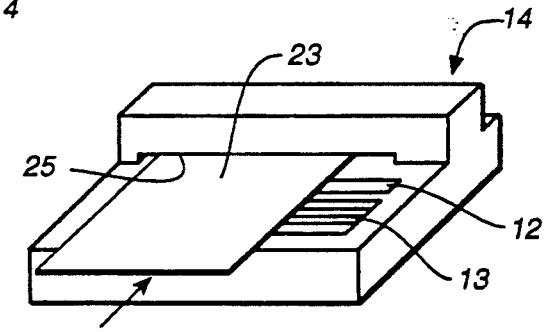
FIG. 3 is a drawing for explaining the operation of the word processor of FIG. 1.

Next, the printing operation of the word processor described above will be explained by way of FIG. 3 in addition to FIGS. 1 and 2. First, the sheet on which printing is intended to be carried out is inserted substantially horizontally through the inlet 25 at the front bottom edge of the cover 25 and a key or keys (not shown) on the keyboard 13 for printing and transporting operations are pressed. This causes the rollers 17 to rotate by a known mechanism in the direction of the arrows shown in FIG. 2, driving the belt 18 and sending the sheet 23 into the printer 14. The sheet 23 is then pressed downward by the members 22 tightly against the upper surface of the belt 18 and is transported substantially horizontally along a straight line by the frictional force between the belt 18 and the sheet 23. At the same time, printing is effected by the printer head 20 and the ink ribbon 21 in a known manner and the sheet 23 is sent out through the outlet 26 at the back bottom edge of the cover 24. The region of the display section 12 where a message related to a printing error or the completion of a printing operation may appear as well as the keys on the keyboard 13 for executing and interrupting a printing operation and for transporting a sheet are so arranged that they are not made inaccessible by the sheet which is being inserted or processed.

In summary, the sheet 23 is not flexed or bent but is advanced along a straight path by the transporting mechanism 16. Thus, printing can be effected by the word processor of the present invention even on an inflexible sheet such as a thick business card or a board.

Figure 4:
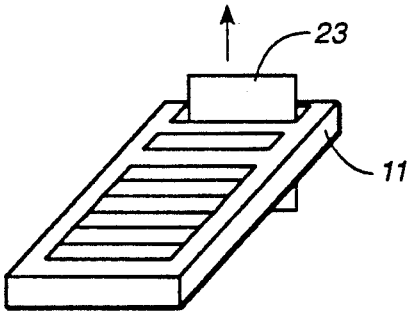
FIG. 4 is a schematic external view of another portable word processor embodying the present invention.
Figure 5:
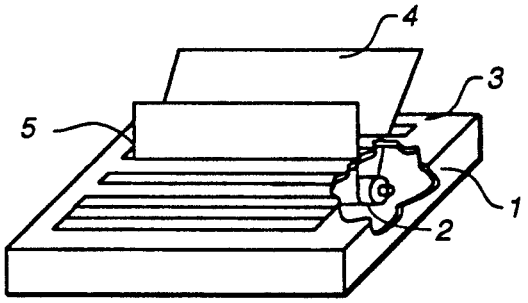
FIG. 5 (PRIOR ART)
FIG. 5 is a partially broken schematic diagonal view of a conventional portable word processor.

The foregoing description of a preferred embodiment of the invention has been presented for purposes of illustration and description. It is not intended to be exhaustive or to limit the invention to the precise form disclosed, and many modifications and variations are possible in light of the above teaching. For example, the printer 14 may be so arranged that the sheet 23 passes through the housing 11 substantially or nearly vertically as shown in FIG. 4. Any modifications and variations that may be apparent to a person skilled in the art are intended to be included within the scope of this invention.

What is claimed is:

1. A portable printer, consisting essentially of:

a printing means for printing on a sheet, a sheet transporting means for advancing the sheet along a straight path without bending or flexing the sheet, and a housing;

said printing means consisting essentially of a printer head and a ribbon;

said sheet transporting means consisting essentially of:

two belt-supporting rollers, a single endless belt conveyer stretched between said two belt-supporting rollers, disposed opposite said printer head and directly contacting said printing sheet to thereby advance said printing sheet past said printer head, a supporting plate which is disposed opposite said printer head and positioned in a manner so as to support a portion of said endless belt conveyer, and two paper-pressing rollers disposed adjacent said printer head and opposite said supporting plate, the two paper-pressing rollers sandwiching said printer head therebetween and providing a biasing force so as to press said printing paper onto said endless belt conveyor; and said housing having an upper surface, said upper surface having an opening which is elongated perpendicularly in the direction of said straight path, the distance between said two belt-supporting rollers being approximately equal to the width of said opening, said supporting plate maintaining a portion of an external surface of said endless belt to be substantially flush with said upper surface.

2. The portable printer of claim 1, wherein said sheet transporting means is so disposed that a printing sheet is advanced approximately horizontally by said sheet transporting means on said upper surface of said housing.

* * * * *